United States Patent [19]

Hashimoto et al.

[11] 4,408,182

[45] Oct. 4, 1983

[54] LIGHTING AND MORSE CODE SIGNALING DEVICE

[76] Inventors: Kazuo Hashimoto, No. 28-2 Komazawa 2-chome; Mutsuo Konno, No. 26-7 Setagaya 4-chome, both of Setagaya-ku, Tokyo, Japan

[21] Appl. No.: 288,511

[22] Filed: Jul. 30, 1981

[30] Foreign Application Priority Data

Aug. 5, 1980 [JP] Japan ..... 55-106713

[51] Int. Cl.[3] ..... G08B 5/31; H05B 41/34

[52] U.S. Cl. ..... 340/321; 178/79; 340/331; 340/345

[58] Field of Search ..... 340/321, 331, 332, 345; 178/82 R, 82 A, 79

[56] References Cited

U.S. PATENT DOCUMENTS

| | | | |
|---|---|---|---|
| 3,205,487 | 9/1965 | Vriend | 340/321 |
| 3,668,684 | 6/1972 | Johnson et al. | 340/321 |
| 3,786,494 | 1/1974 | Clark | 340/345 |
| 3,810,150 | 5/1974 | Jacobs | 340/331 |
| 4,058,679 | 6/1978 | Hashimoto | 178/6 R |
| 4,124,842 | 11/1978 | Bachelor | 340/331 |
| 4,163,220 | 7/1979 | Henningsen et al. | 340/345 |

*Primary Examiner*—James J. Groody

*Attorney, Agent, or Firm*—Lowe, King, Price and Becker

[57] ABSTRACT

A lighting and signaling device is provided which is capable of both lighting and signaling intermittent signals such as Morse code signals. The lighting and signaling device has a switch for selecting among an unlit mode, a continuous lighting mode, and an intermittent lighting mode; a clock circuit for oscillating at a single frequency in the intermittent lighting mode; a plurality of decade counters responsive to the clock circuit; and a driver for outputting periodic signals from outputs from the decade counters. The decade counters are arranged so as to output a series of dot and dash signals according to a predetermined program. The circuitry is housed within a portable flashlight.

2 Claims, 2 Drawing Figures

R2
R1
C1
V
1
2
3
4
5
8
1
16
14
CL
8
Vss
IC2
13
CE
(CTR)
15
R
Q0
Q2
Q4
Q6
Q7
Q8
Q9
3
4
10
5
6
9
11
D0
D2
D4
D6
D7
D8
Vcc
14
4
AND1
7
IC3
D3
AND2
8
IC4
AND3
IC5
+B
Ry-1
R3
Tr1
R4
L.P.

LIGHTING AND MORSE CODE SIGNALING DEVICE

TECHNICAL FIELD

The present invention relates to a lighting and signaling device. More specifically, the present invention relates to a lighting and signaling device which goes on and off to provide intermittent signals representing a series of particular characters, symbols or the like.

BACKGROUND ART

A portable lighting device is known which may be switched between the continuous lighting mode and the intermittent lighting mode by a switching operation. A portable flashlight is also known which may be lit only while a pushbutton switch is depressed. However, when transmitting with these conventional portable flashlights, Morse signals representing "SOS" (dot, dot, dot, dash, dash, dash, dot, dot, dot), the pushbutton switch must be depressed the number of times and durations necessary for generating these signals. Furthermore, the relative ratio of the dot and dash signals of the Morse signal to the blank periods therebetween is controlled manually, resulting in inaccuracy. In particular, in the case of an emergency such as an accident or distress, it may not be possible to manually transmit signals to somebody else. When signaling an SOS with a portable flashlight by manually switching on and off the flashlight, or by flashing non-periodically with the use of a bimetal or the like, the signaling may simply be regarded as mischivous behavior or a greeting between boats or the like. This makes it impossible to prevent disastrous accidents or to rescue people from such accidents.

DISCLOSURE OF INVENTION

It is an object of the present invention to provide a lighting and signaling device which eliminates the drawbacks as described above and which may be switched by a switching operation between the continuous lighting mode and the mode for correctly lighting a lamp according to Morse signals representing SOS, by combining counter outputs by operating a built-in oscillator and built-in counter circuits.

It is another object of the present invention to provide a lighting and signaling device which incorporates in a flashlight a unit for generating a series of periodic dot and dash signals of an emergency signal such as SOS, so that addition of the function of indicating a series of periodic dot and dash signals such as SOS may be facilitated and carrying it on a boat or the like may be easy.

In order to achieve these objects, the present invention provides a lighting and signaling device comprising means for selecting among an unlit mode, a continuous lighting mode, and an intermittent lighting mode; means for oscillating at a single frequency in said intermittent lighting mode; a plurality of decade counters rendered operative by said oscillating means; and means for outputting a series of periodic dot and dash signals according to a predetermined program by combining outputs of said decade counters.

The lighting and signaling device of the present invention is further characterized in that these means are housed in a flashlight.

BEST MODE FOR CARRYING OUT THE INVENTION

Figure 1:
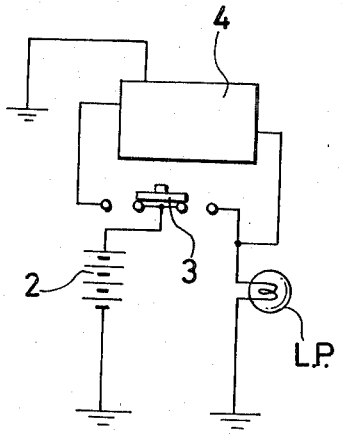
FIG. 1 is a circuit diagram of one embodiment of the present invention.

Referring to FIG. 1, reference numeral 2 denotes a power source, one end of which is connected to the central terminal of a slide switch 3 and the other end of which is grounded. One terminal of the slide switch 3 is grounded through a lamp L·P and the other terminal thereof is connected to the lamp L·P through an intermittent signal generator 4.

When the slider of the slide switch 3 under the unlit condition is slid in one direction, the power source 2 is connected to the lamp L·P to continuously light the lamp L·P. When the slider of the slide switch 3 is slid in the other direction, the power source 2 is connected to the lamp L·P through the intermittent signal generator 4 to intermittently light the lamp L·P.

Figure 2:
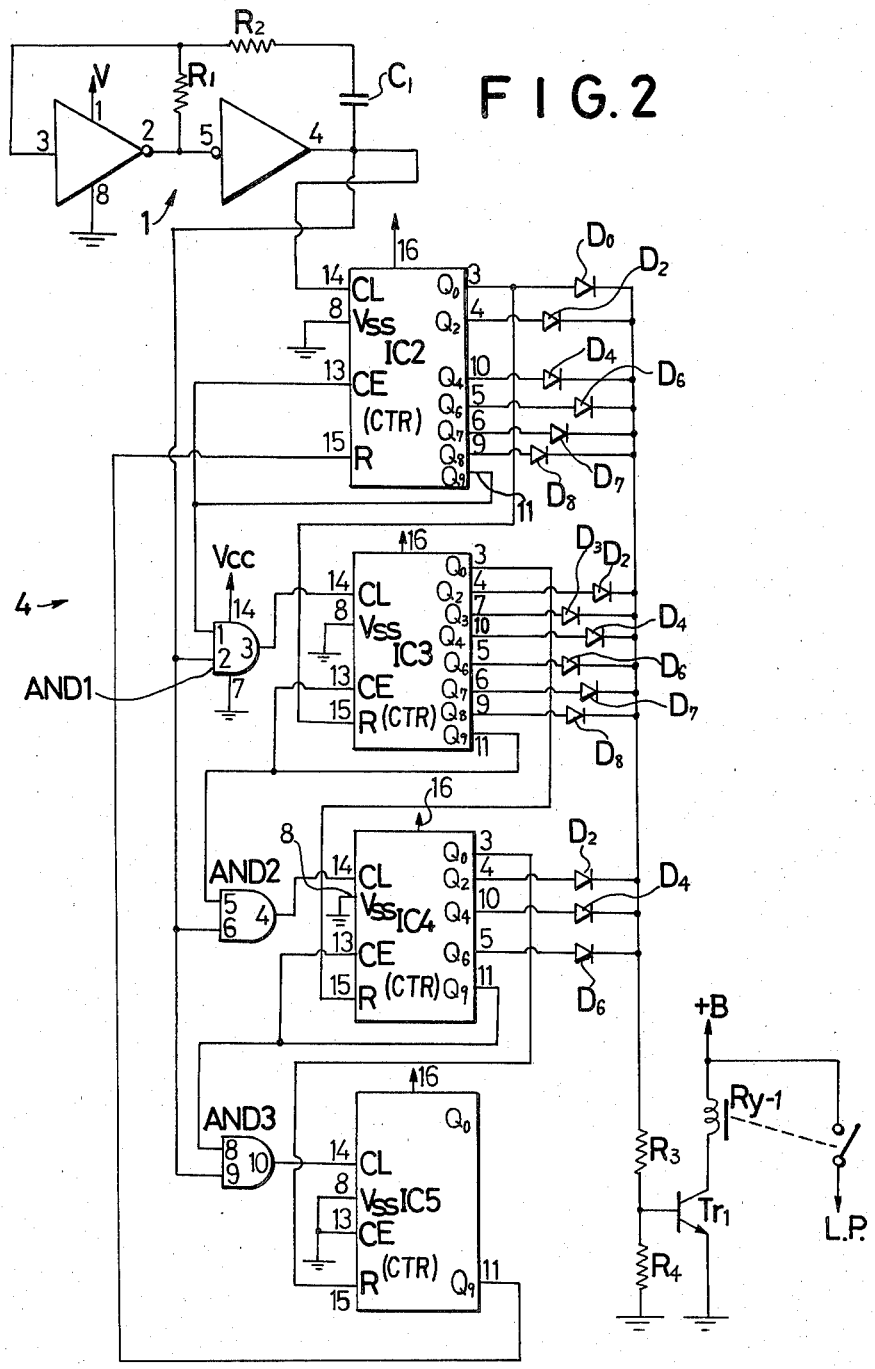
FIG. 2 is a circuit diagram of the main part of FIG. 1.

FIG. 2 shows in detail the intermittent signal generator 4 of FIG. 1. An oscillator 1 shown in FIG. 2 comprises a known astable multivibrator using inverters or buffers, the single oscillating frequency of which is determined to be, for example, 33 Hz by the resistance of a resistor R1 and the capacitance of a capacitor C1. The oscillator shown in the figure is, for example, a CMOS·IC, MC 14049 (⅓ circuit) available from Motorola. The output of this oscillator 1 is input to a clock terminal CL of an IC decade counter, IC2. IC2 to IC5 are, for example, CMOS·ICs, MC 14017 available from Motorola, and IC2 and IC4 are decade counters for generating signals. In the description to follow, IC2 to IC5 are assumed to be under the reset condition.

Among the output terminals of the IC decade counter IC2 of the previous stage, terminals Q0, Q2, Q4, Q6, Q7, and Q8 are connected to the base of a transistor Tr1 through a common resistor R3 and diodes D0, D2, D4, D6, D7, and D8, respectively. The base of the transistor Tr1 is grounded through a resistor R4. Similarly, the emitter of the transistor Tr1 is grounded, and the collector thereof is connected to a +B power source through a drive coil of a relay $R_{y-1}$. The IC decade counter IC2 counts the signals input to the clock terminal CL and switches the transistor Tr1 to generate a dot signal, a dot signal, a dot signal, and a dash signal by outputs of high level connected through the diodes D0 to D8 among the output terminals Q0 to Q8. The duration ratio of the signal to the space is 1:1 and the ratio of the dot signal to the dash signal is 1:3. When the output of high level appears at final terminal Q9, the counting operation of the IC decade counter IC2 is interrupted while the terminal Q9 is maintained at high level since the output of the terminal Q9 is input to a clock enable terminal CE. Since the output of the terminal Q9 is connected to one input terminal of an AND circuit, AND 1, the AND circuit AND 1 supplies the signals generated from the oscillator 1 to the clock terminal CL of the IC decade counter of the next stage, IC3 when the output of the terminal Q9 is of high level. AND circuits AND 1 to AND 3 are, for example, CMOS·ICs, MC 14081 (1/6 circuit) available from Motorola. The IC decade counter IC3 then starts counting and sequentially generates signals of high level from terminal Q0. Among the Q outputs, the outputs from terminals Q2, Q3, Q4, Q6, Q7 and Q8 are connected to the base of the transistor Tr1 through the common resistor R3 and diodes D2, D3, D4, D6, D7, and D8. Accordingly, the transistor Tr1 conducts for a dash signal and another dash signal by the outputs of high level of the IC decade counter IC3. When the final terminal Q9 of the IC decade counter IC3 becomes high level, the IC decade counter IC3 interrupts counting while the output of the terminal Q9 is maintained at high level since the terminal Q9 is connected to the clock enable terminal CE. Similarly, the output of the terminal Q9 of the IC decade counter IC3 is input to one input terminal of the AND circuit AND 2. The AND circuit AND 2 supplies the signals generated from the oscillator 1 connected to its other input terminal to the clock terminal CL of the IC decade counter IC4. The IC decade counter IC4 sequentually outputs count outputs from the terminal Q0. Among the Q outputs of the IC decade counter IC4, terminals Q2, Q4 and Q6 are connected to the base of the transistor Tr1 through the common resistor R3 and diodes D2, D4 and D6, respectively. Accordingly, the transistor Tr1 is switched on for a dot signal, a dot signal, and a dot signal by the outputs of high level from the IC decade counter IC4. When the output of the final terminal Q9 becomes high level subsequently, the IC decade counter IC4 interrupts counting while the output of the terminal Q9 is kept at high level since the output of the terminal Q9 is input to the clock enable terminal CE of the IC decade counter IC4. Since the output of the terminal Q9 of the IC decade counter IC4 is input to one input terminal of an AND circuit AND 3, the AND circuit AND 3 supplies the signals generated by the oscillator 1 to the clock terminal CL of the IC decade counter IC5. The IC decade counter IC5 sequentially outputs count outputs of high level from the terminal Q9. Since the output terminal Q9 of the IC decade counter IC5 is connected to a reset terminal R of the IC decade counter IC2, the IC decade counter IC2 is reset when the output of the terminal Q9 of the IC decade counter IC5 becomes high level. Then, the output of the terminal Q9 of the IC decade counter IC2 becomes low level, rendering the IC decade counter IC2 operative. Simultaneously, one input to the AND circuit AND 1 also becomes low level, so the AND circuit AND 1 no longer supplies the signals generated by the oscillator 1 to the clock terminal CL of the IC decade counter IC3. When the IC decade counter IC2 is rendered operative, the output of the terminal Q9 becomes high level, thus resetting the IC decade counter IC3. Thus, the output of the terminal Q9 of the IC decade counter IC3 becomes low level, the IC decade counter IC3 is rendered operative. Simultaneously, since the output of the terminal Q0 of the IC decade counter IC3 becomes high level, the IC decade counter IC4 is reset. Simultaneously, the output of the terminal Q9 of the IC decade counter IC4 becomes low level, so the signals generated by the oscillator 1 are no longer supplied through the AND circuit AND 3 to the IC decade counter IC5. Further, since the output of the terminal Q0 of the IC decade counter IC4 becomes high level, the IC decade counter IC5 is reset. In other words, the output of the terminal Q9 of the IC decade counter IC5 resets the IC decade counters IC2, IC3, and IC4, subsequently resets the IC decade counter IC5, and renders the IC decade counter IC2 alone operative. In the manner as described above, the IC decade counter IC2 restarts counting by the outputs from the oscillator 1 which are input to the clock terminal CL of the IC decade counter IC2.

According to one sequence of the IC circuit as described above, the lamp L·P driven by the relay $R_{y-1}$ connected to the transistor Tr1 signals according to the Morse signals representing SOS, "dot, dot, dot, dash, dash, dash, dot, dot, dot". After a period corresponding in duration to 8 dot signals, the lamp L·P repeats the same signaling operation. The lamp L·P is lit through the intermediacy of the relay $R_{y-1}$ so that the lamp L·P of the power source 2 may be lit without considering the internal resistance of the transistor Tr1, thereby enabling longer operation in the case of an emergency.

In the embodiment described above, the description has been made with respect to the circuit configuration for generating Morse signals representing SOS. For example, signaling of characters, symbols, and so on which may be represented by the combination of dot and dash signals may be achieved by simply modifying the diode connection to the Q terminals of the IC circuits. It is also to be understood that a longer combination of signals may also be achieved by adding IC decade counters IC6, IC7, . . . in place of the IC decade counter IC5 and arranging the IC decade counter IC5 at the end.

We claim:

1. A lighting and S.O.S. Morse code signaling device device, comprising a lamp and means for selectively connecting said lamp to a power source, said connecting means including means for selecting among an unlit mode, a continuous lighting mode and an intermittent lighting mode; means operative during said intermittent lighting mode for generating constant pulse repetition rate pulses; plural decade counters for counting said pulses during said intermittent lighting mode and having an output terminal corresponding respectively to each count value; and means for controlling said lamp to develop an S.O.S. Morse code signal including means for driving said lamp initially by alternate terminals in succession of said plural decade counters to develop three successive "dot" signals, then by three sets successively of three successive terminals, with one unused terminal between each set, of said plural decade counters to develop three successive "dash" signals and then by alternate terminals in succession of said plural decade counters to develop three successive "dot" signals.

2. A lighting and S.O.S. Morse code signaling device according to claim 1, wherein said lamp controlling means comprises an additional decade counter means responsive to said plural decade counters for recirculating the Morse code signal to said plural decade counters following a delay period.

* * * * *